United States Patent [19]

Futere et al.

[11] 4,344,189

[45] Aug. 17, 1982

[54] LIMB PROTECTOR FOR ATHLETES

[76] Inventors: Albert L. Futere, 4901-17th Ave. South; Michael J. Kelly, 808 NE. 82nd, both of Seattle, Wash. 98108

[21] Appl. No.: 957,992

[22] Filed: Nov. 6, 1978

Related U.S. Application Data

[63] Continuation-in-part of Ser. No. 850,712, Nov. 11, 1977, abandoned, which is a continuation-in-part of Ser. No. 757,246, Jan. 6, 1977, abandoned, which is a continuation-in-part of Ser. No. 552,551, Feb. 24, 1975, Pat. No. 4,001,953, which is a continuation-in-part of Ser. No. 461,156, Apr. 15, 1974, abandoned.

[51] Int. Cl.[2] ..... A41D 13/08; A41D 17/00

[52] U.S. Cl. ..... 2/16; 36/2 R

[58] Field of Search ..... 36/2 R; 2/16, 22

[56] References Cited

U.S. PATENT DOCUMENTS

| | | | |
|---|---|---|---|
| 2,082,574 | 6/1937 | Handley | 2/16 |
| 3,465,364 | 9/1969 | Edelson | 2/22 |
| 3,721,997 | 3/1973 | Mundt | 36/2 R |
| 4,011,596 | 3/1977 | Chang | 2/16 |
| 4,067,063 | 1/1978 | Ettinger | 2/16 |

FOREIGN PATENT DOCUMENTS

| | | | |
|---|---|---|---|
| 2310149 | 3/1973 | Fed. Rep. of Germany | 36/2 R |

*Primary Examiner*—Patrick D. Lawson

*Attorney, Agent, or Firm*—Cole, Jensen & Puntigam

[57] ABSTRACT

In one embodiment, the limb protector is a protective gaiter which extends from the wearer's instep to just below his knee. A portion of the gaiter forms a completely closed pocket which contains an energy absorbing pad. The pocket and the pad are both configured so that the pad fits over and protects the wearer's shinbones, as well as covering many of the major bones and muscles of the wearer's leg. In another embodiment, the limb protector is an arm guard which extends from the wearer's elbow to his wrist. The arm guard includes a tapered sleeve-like element which is sufficiently elastic that it bears tightly about the arm of a user. A pocket is provided in the sleeve-like element to receive a protective pad. Elastic means are provided at both ends of the sleeve-like element to assist in preventing circumferential and longitudinal movement of the protector, even with violent movement of the user's arm.

5 Claims, 35 Drawing Figures

Fig. 5a.
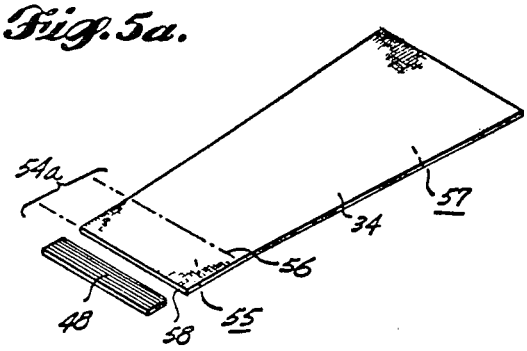
Fig. 5b.
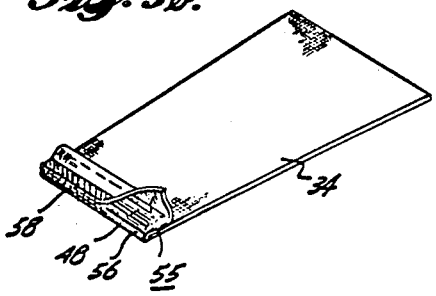
Fig. 6.
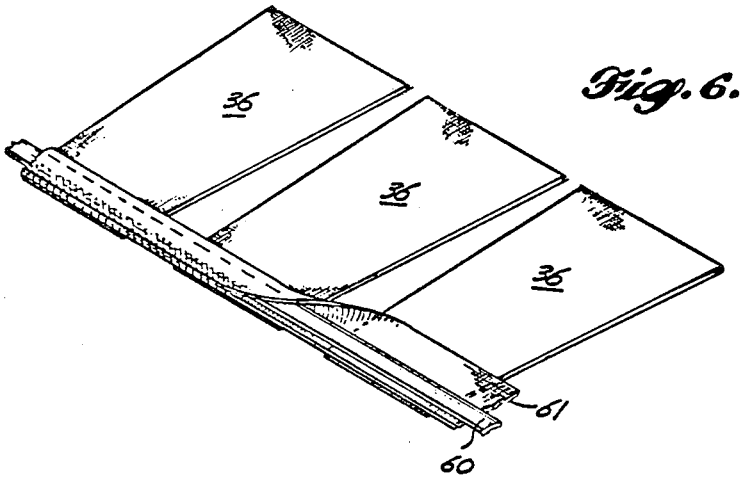
Fig. 7a.
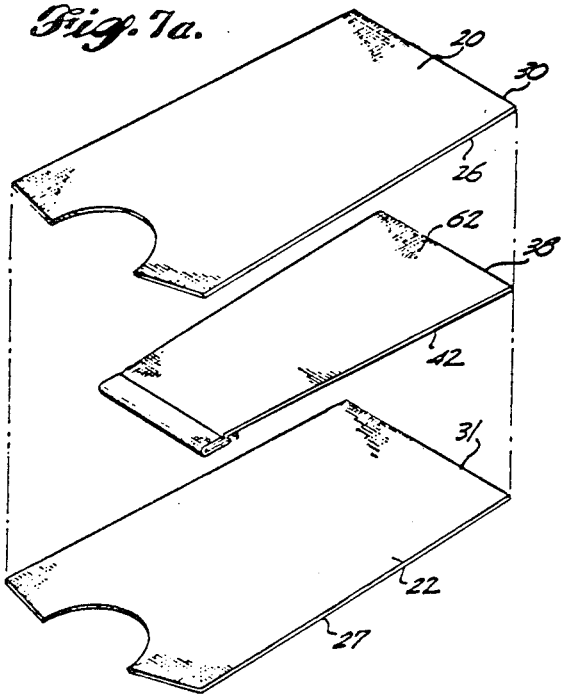
Fig. 7b.
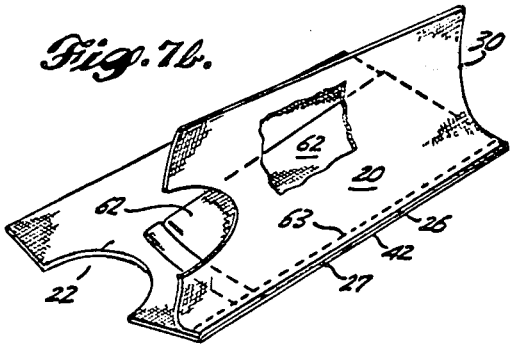
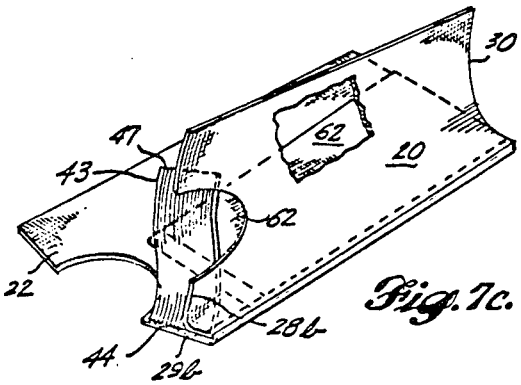
Fig. 7c.

Fig. 7d.
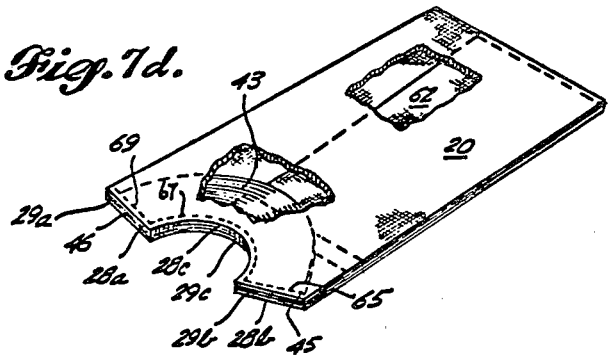
Fig. 7e.
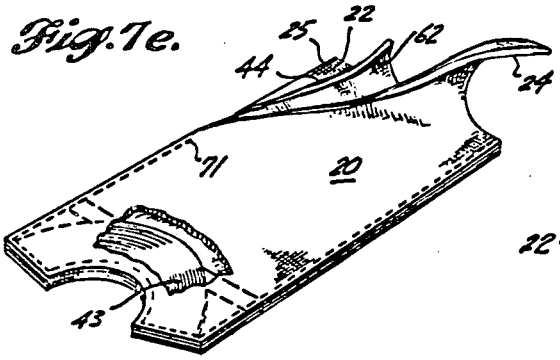
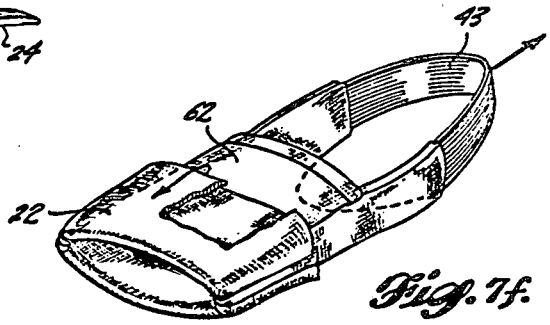
Fig. 7f.
Fig. 7g.
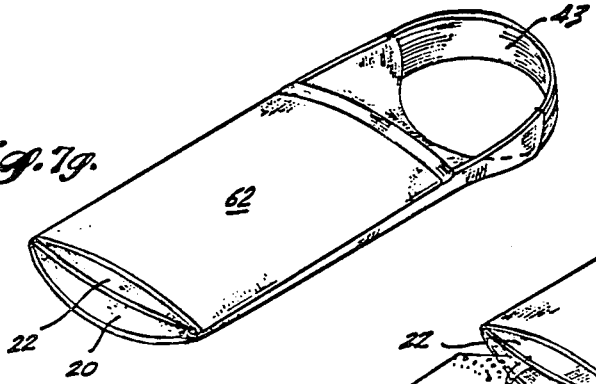
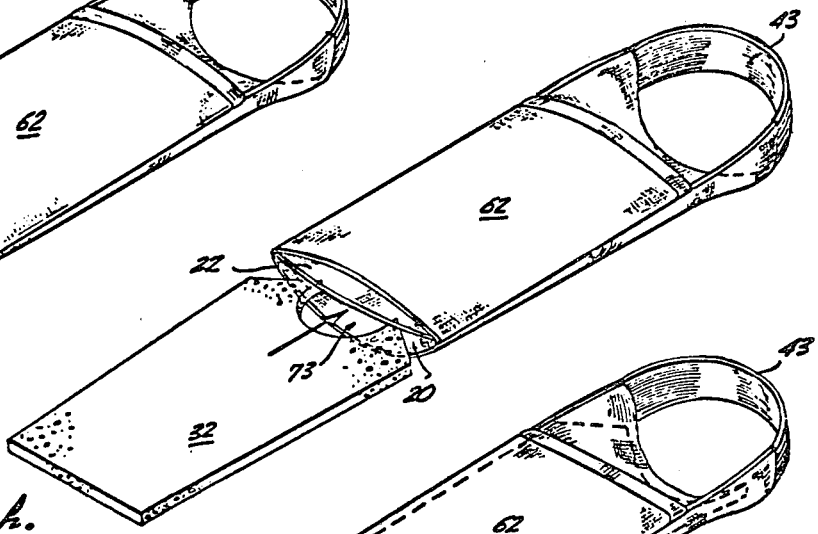
Fig. 7h.
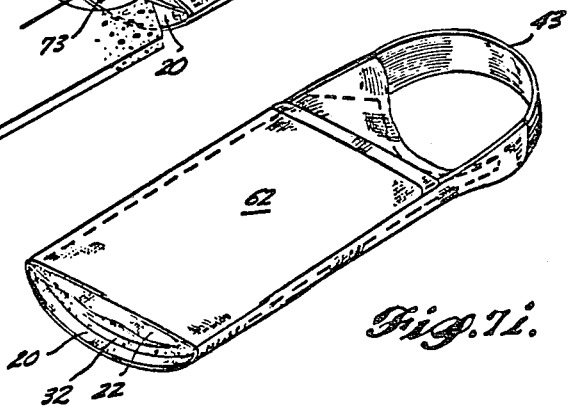
Fig. 7i.

Fig. 8a.
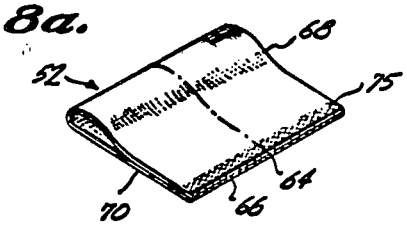
Fig. 8b.
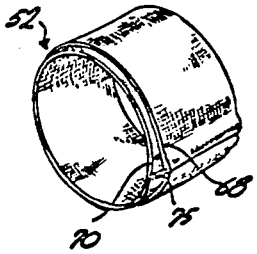
Fig. 9a.
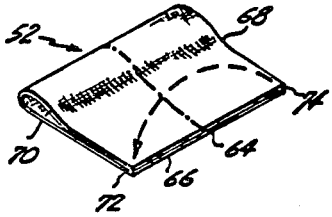
Fig. 9b.
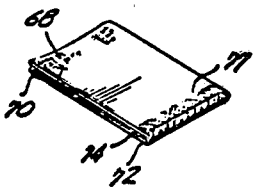
Fig. 9c.
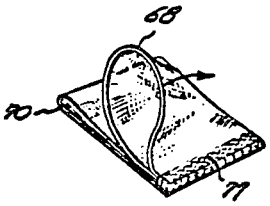
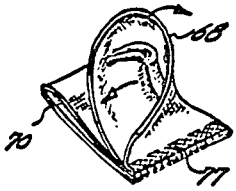
Fig. 9d.
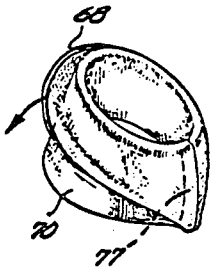
Fig. 9e.
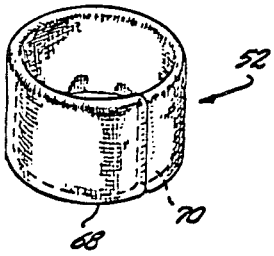
Fig. 9f.

Fig. 13
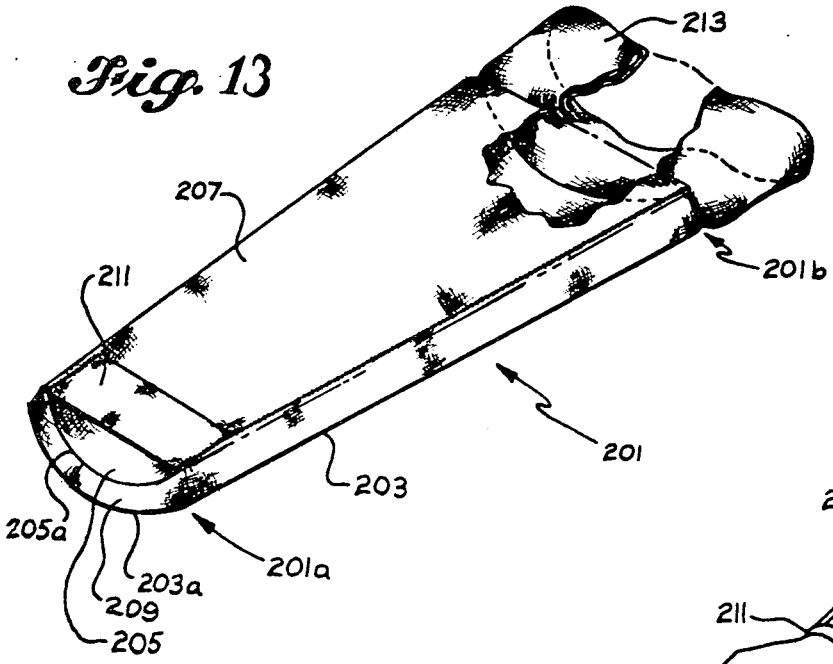
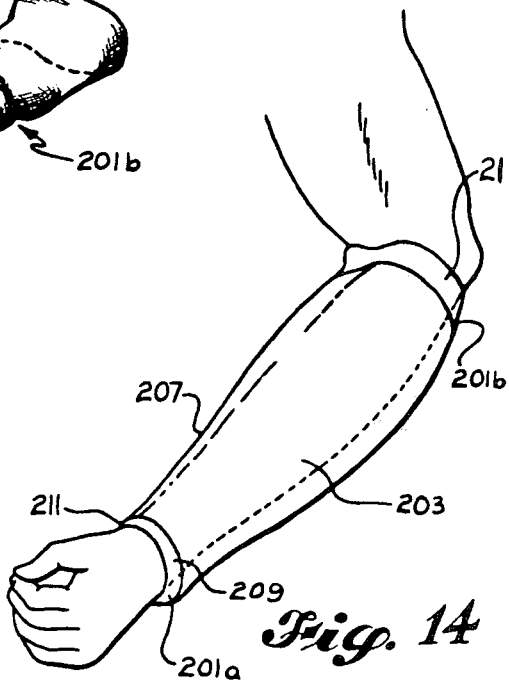
Fig. 14

LIMB PROTECTOR FOR ATHLETES

BACKGROUND OF THE INVENTION

This is a continuation-in-part of application Ser. No. 850,712 filed Nov. 11, 1977, now abandoned titled Limb Protector for Athletes, which in turn is a continuation-in-part of application Ser. No. 757,246, filed Jan. 6, 1977, now abandoned which in turn is a continuation-in-part of application Ser. No. 552,551, filed Feb. 24, 1975, now U.S. Pat. No. 4,001,953, which in turn is a continuation-in-part of application Ser. No. 461,156, filed Apr. 15, 1974, now abandoned.

This invention relates generally to the art of protective sporting equipment, and in particular is concerned with protective gaiters useful in protecting the limbs of a participant in contact sports such as soccer and hockey.

There are several types of energy-absorbing leg or arm guards for athletes known in the art. However, almost all of these devices have been designed exclusively for the major American sports, such as football and baseball. The available leg guard devices are thus typically unsuitable for other contact sports, notably soccer. For instance, the available guards are typically secured to the wearer's legs by means of straps or by insertion of the guard element between the wearer's leg and his stocking. The insertable type guard element is typically taped to the player's leg to maintain its position. Both this arrangement and the strap configuration have several disadvantages, however, particularly in that the wearer is required to constantly adjust and tighten his leg guards. This necessity of adjustment distracts the wearer, thereby reducing his concentration and attention, and hence, his skill, at the particular game he is playing.

The present invention in one embodiment combines a stocking or gaiter, which is a common part of an athlete's uniform, with an energy-absorbing protective pad, thereby eliminating the necessity of straps or tape. The combination of protective pad and gaiter provides an inexpensive, simple, and reliable means for protecting the shins, muscles and bones of the lower leg and ankle of the wearer. Preferably, the gaiter itself is made from stretchable nylon, sufficiently pliable to fit the curvature of the wearer's leg from his ankle to his knee, without being unduly rigid. The stretchable nylon performs two functions. It is an integral part of the uniform of the athlete wearer e.g. soccer player, and will typically be in a corresponding color with the rest of the uniform, and it secures the protective pad and maintains it in proper position relative to the lower leg and ankle during play. The stretchable nylon and the energy-absorbing pad, which is preferably a closed-cell, foam-like material, are conveniently washable and thus may be washed or cleaned with the other parts of the athletic uniform.

In another embodiment, the energy-absorbing pad is combined with a gaiter in the form of a sleeve, with the material of the sleeve being sufficiently elastic and the sleeve so configured that the combination fits tightly about the forearm or lower leg of a user, preventing movement thereof even during violent movement of the user.

Other objects and advantages of the invention will become apparent during the course of the following description.

SUMMARY OF THE INVENTION

Accordingly, the present invention is an arm guard which includes a generally cylindrical sleeve-like element which has a closed pocket defined therein, a protective pad which is positioned in the closed pocket, and an elastic strap secured to the sleeve-like element at a particular point. The sleeve-like element is tapered from one end to the other and is otherwise configured to substantially conform to the shape of a human forearm. The closed pocket defined in the sleeve-like element extends from substantially the one end thereof to the other end and extends around approximately one-half of the circumference of the sleeve-like element. The sleeve-like element, when it is stretched to fit over the user's forearm, is sufficiently elastic that it and the protective pad are held in place on the user's arm, even during violent movement thereof, including contact with another object. The protective pad, which is positioned in the closed pocket, also is tapered from one end to the other, extends substantially the length of the sleeve-like element, and around substantially one-half of the user's forearm when the arm guard is in place thereon. The protective pad is sufficiently flexible that it flexes to substantially conform to the circumferential outline of the user's forearm. The elastic strap means is a band of elastic material which is stiffer elastically than the material comprising said sleeve-like element and is secured to the sleeve-like element at a point which is in the vicinity of the user's wrist when the article is in place. The inner circumference of the article at said point is sufficiently less than the circumference of the user's wrist so that the band grips the user's wrist when in place, thereby assisting in preventing movement of the article along the user's forearm.

DESCRIPTION OF THE DRAWINGS

FIG. 5*a* is an isometric view showing the first step in an alternative method of securing an elastic back strap to the back panel, showing the relative sizes of the parts.

FIG. 5*b* is an isometric view showing the second step of the method of FIG. 5*a*, in which the back strap is covered by a folded portion of the back panel adjacent its lower edge.

FIG. 6 is an isometric view showing the method of manufacturing more than one back panel/back strap using the method of FIGS. 4*a*–4*c* but with a single strap of elastic back strap material cover used with several back panels.

FIG. 7*a* is an isometric view showing a preliminary step in the method of the present invention, illustrating the vertical alignment and relative positions of the front panel, back panel and liner panel prior to the first sewing step in the method of manufacturing the protective gaiter.

FIG. 7*b* is an isometric view showing the step in such a method of securing the back panel, liner panel and front panel together along aligned longitudinal edges thereof.

FIG. 7*c* is an isometric view showing the step in such a method of attaching one end of the elastic foot strap to the combination of back panel, front panel and liner panel.

FIG. 7*d* is an isometric view showing the step in such a method of attaching the other end of the elastic foot strap to the combination of back panel, front panel, and liner panel, forming the stirrup, and the step of securing together the lower edges of the front panel and liner panel.

FIG. 7*e* is an isometric view showing the step in such a method of securing together of the other longitudinal edges of the back panel, front panel and liner panel.

FIG. 7*f* is an isometric view showing the step in such a method of pulling the article of FIG. 7*e* inside out.

FIG. 7*g* is an isometric view showing the protective gaiter rightside out.

FIG. 7*h* is an isometric view showing the step in such a method of inserting the protective pad into the pocket formed by the now-adjacent front and liner panels.

FIG. 7*i* is an isometric view showing the combination of gaiter and protective pad after completion of the step of FIG. 7*h*.

FIG. 8*a* is an isometric view showing the first step in a first alternative method of manufacturing the collar for the protective gaiter, in which the opposite ends of the collar panel are sewn together.

FIG. 8*b* is an isometric view showing the second step of the method of FIG. 8*a*, in which the sewn collar is folded longitudinally upon itself.

FIG. 9*a* is an isometric view showing the initial step in a second alternative method of manufacturing the collar for the protective gaiter, in which the collar panel is folded laterally back upon itself such that its respective ends terminate in a common plane.

FIG. 9*b* is an isometric view showing the step of the method of FIG. 9*a*, in which the once-folded collar of FIG. 9*a* is folded longitudinally and sewn along the folded adjacent end edges.

FIG. 9*c* is an isometric view showing the step of the method of FIGS. 9*a* and 9*b*, in which a portion of one longitudinal edge is opened in the shape of a loop.

FIGS. 9*d* and 9*e* are isometric views showing the step of the method of FIGS. 9*a* through 9*c*, in which the loop is folded over the remainder of the folded collar, reversing the sewn end edges to the inside of the collar.

FIG. 9*f* is an isometric view showing the finished collar from the method of FIGS. 9*a* through 9*e*.

FIG. 13 is an isometric, partially-cutaway, view of another embodiment of the present invention.

FIG. 14 is a pictorial view of the article of FIG. 13, shown in place on a user's forearm.

DESCRIPTION OF THE PREFERRED EMBODIMENT

Figure 2:
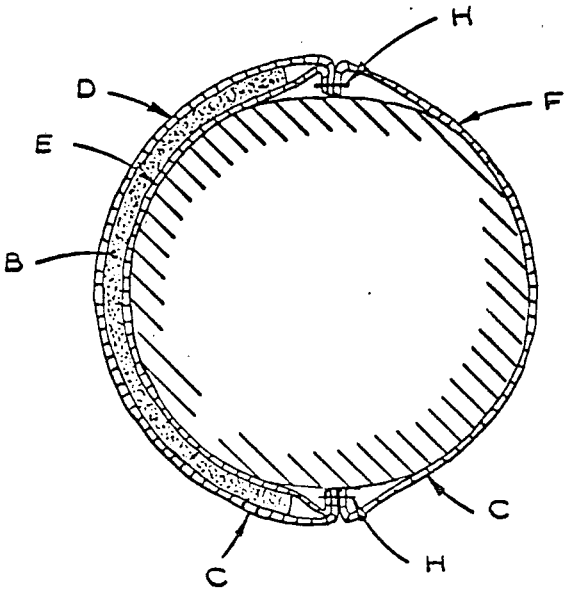
FIG. 2 is a cross-sectional view of the combination shown in FIG. 1, taken along lines A—A of FIG. 1.
Figure 1:
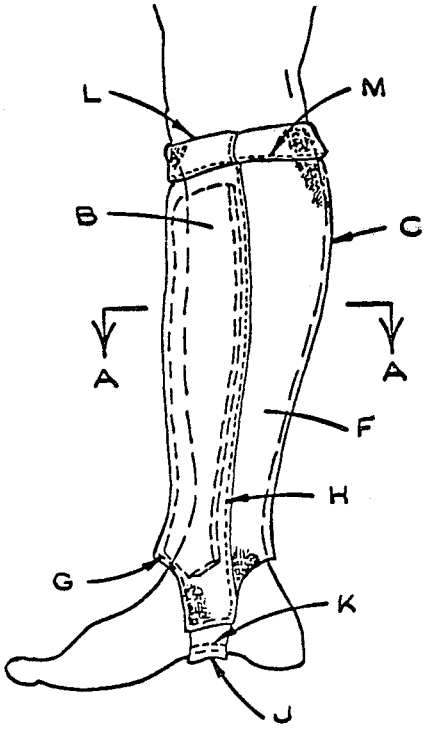
FIG. 1 is a side elevation view of the combination of gaiter and protective pad in place on a wearer's leg.

In FIGS. 1 and 2, wherein, for the purpose of illustration, is shown a preferred embodiment of the invention, the letter "B" designates a closed cell, polyvinyl chloride, energy-absorbing material. This energy-absorbing material is utilized as a protective leg and shin guard and is shaped so as to cover certain muscles and bones of the lower leg of a wearer, namely, the tibiales anterior and extensor hollucis longus muscles, and the tibia and lateral mallelus bones of the lower leg. The gaiter, designated by the letter "C" in FIGS. 1 and 2, is fabricated in the preferred embodiment with two sections of nylon material which may be stretchable, designated by the letters "D" and "E" in FIGS. 1 and 2, and a section of a synthetic nylon material with stretch qualities, designated by the letter "F".

The details of the method of manufacture of the protective gaiter will be more thoroughly discussed in following paragraphs. The stretch material which is preferably utilized for the gaiter provides the gaiter with its form-fitting and support qualities and holds the protective pad B in position relative to the gaiter and to the leg of the wearer. The three sections of material D, E and F are sewn together along the opposing seams designated H, which are adjacent the longitudinal edges of the protective pad B, and are also sewn together adjacent the lower edge of the material sections D and E, as shown by the seam designated by the letter "G" in FIG. 1. The protective pad B is inserted between the material sections D and E, which form a pocket for the pad B, holding it in place when the gaiter is in use.

The gaiter is fitted with an elastic strap designated by the letter "J" in FIG. 1 that forms the stirrup of the protective gaiter and thereby assists in holding the gaiter and the protective pad in position, when the protective gaiter is on the leg of the wearer. The elastic stirrup J is serge stitched at the point where it is secured to the material sections D and E, at the seam design at "K" in FIG. 1. An elastic cuff or collar is positioned adjacent and secured to the upper edge of the material sections D, E and F, the collar being designated by the letter "L" in FIG. 1. The collar is stitched along the seam designated "M" in FIG. 1 to the upper edge of the material sections D, E, and F, with the upper edges of sections D and E being joined together along their length, thereby resulting in a completely closed seam around the protective pad B.

Although the protective gaiter is primarily designed to be used in playing the game of soccer, it can be used with equal facility in virtually any contact sport, for instance, football, rugby, basketball and baseball. Additionally, although the gaiter will find its primary use on the legs of a wearer, it can be used as a protective device for the arm as well. An embodiment of the present invention which is particularly adapted for use on the user's forearm, but which could also be used on the user's lower leg, is shown in FIGS. 13–17 and described in detail hereinafter.

Figure 3:
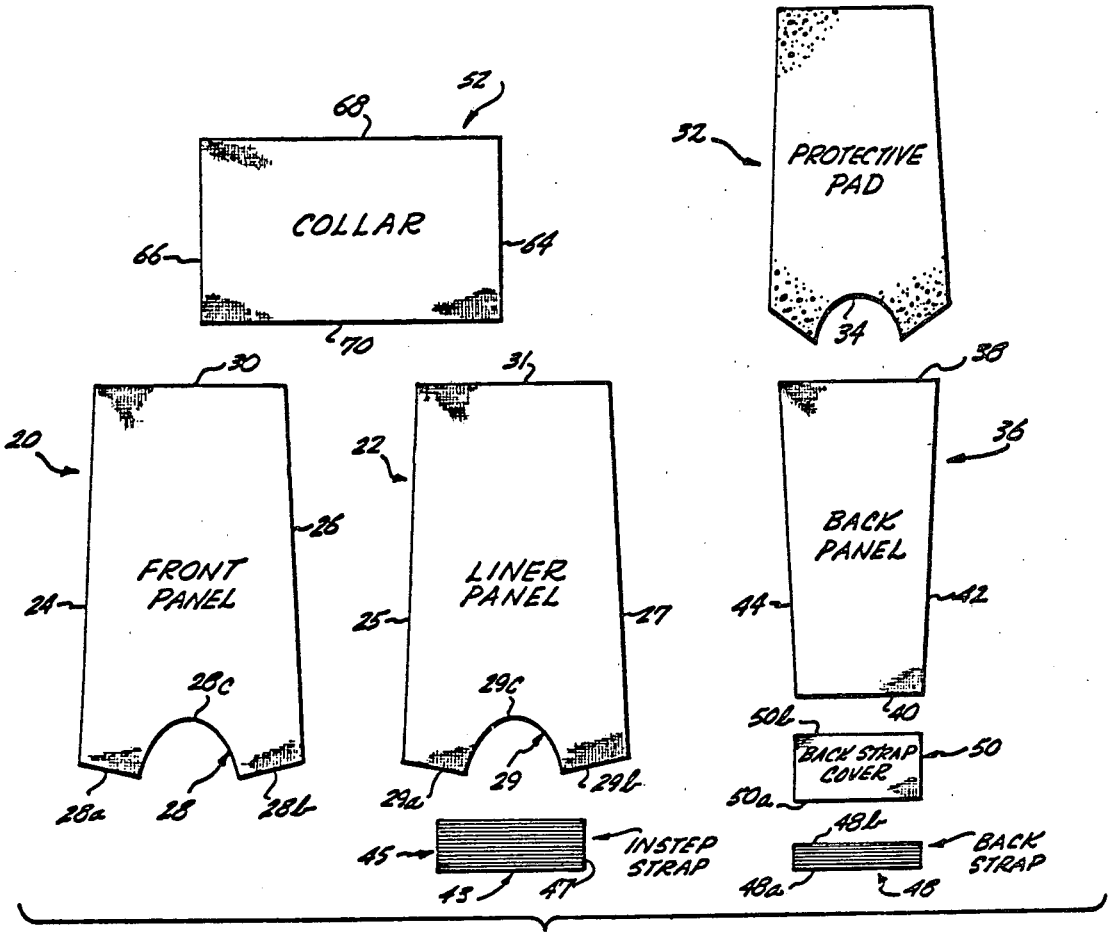
FIG. 3 is a plan view showing the various parts of the protective gaiter.

FIG. 3 shows relative-sized patterns for the various parts of the protective gaiter. Front panel 20 and liner panel 22 are identical and are preferably made from a stretchable nylon or other washable synthetic fabric. Front panel 20 and liner panel 22, as well as other nylon parts of the protective gaiter are preferably cut so that the maximum stretch is in the transverse direction. Front panel 20 and liner panel 22 are preferably quadrilateral in outline, each panel having three substantially straight edges and a fourth edge which has a particular shape discussed more fully in following paragraphs. Front panel 20 has longitudinal edges 24 and 26, lower edge 28, and upper edge 30, longitudinal edges 24 and 26 converging slightly toward each other as they extend from lower edge 28 to upper edge 30. Lower edge 28 comprises three successive portions between longitudinal edges 24 and 26, opposite straight end portions **28*a* and 28*b*, and intermediate end portion 28*c*. Opposite straight end portions 28*a* and 28*b* are both straight and each extends inwardly from the respective longitudinal edges 24 and 26 approximately one-third of the straight-line distance between longitudinal edges 24 and 26**.

Opposite straight end portions also extend somewhat downwardly relative to a straight line connecting the respective intersections of said opposite straight end portions with longitudinal edges 24 and 26, and preferably, although not necessarily, the angle between longitudinal edges 24 and 26 and their associated end portions **28*a* and 28*b* is between 100° and 120°, for appearance, fit and economy of material. Intermediate end portion 28*c* is concave in outline, and in the preferred embodiment takes the form of a half-ellipse. The shape of the lower edge 28 of front panel and liner panel 22 permits the protective gaiter to cover the upper part of the wearer's foot, as well as his shins. The exact shape of the intermediate end portion 28*c*, the angular relationship between longitudinal edges 24, 26 and opposite straight end portions 28*a*, 28*b* and the dimensional relationship between portions 28*a*, 28*b*, 28*c* of lower edge 28 all may be varied, so long as adequate protection to the upper foot, ankles and shins of a wearer is accomplished. Furthermore, although the dimensions of the front and liner panels 20 and 22** may also be varied, they must be long enough to extend from substantially the wearer's knee to his instep, and wide enough to produce a gaiter which will surround the wearer's leg. As an example, front and liner panels for medium-sized gaiters will have longitudinal edges approximately 13 inches and an upper edge approximately 6 inches long. The topmost extent of the intermediate end portions will be approximately 2 inches from the lower edges.

As mentioned above, liner panel 22 is substantially identical in size and shape to front panel 20. Referring to FIG. 3, liner panel 22 has longitudinal edges 25 and 27, lower edge 29, and upper edge 31, with lower edge 29 comprised of straight end portions **29*a* and 29*b* and concavely shaped intermediate end portion 29*c***.

Protective pad 32 is similar in shape to front panel 20 and liner panel 22, as protective pad 32 is, in the finished article, positioned in a pocket formed between front panel 20 and liner panel 22. Thus, protective pad 32 has a lower edge 34 which is similar in outline to lower edge 28 of the front panel 20 and lower edge 29 of liner panel 22. The protective pad 32 will, however, have slightly smaller dimensions than front panel 20 and liner panel 22, so that it may be easily inserted therebetween when the corresponding longitudinal and lower edges of the front panel 20 and liner panel 22 are secured together. For a medium sized gaiter, the protective pad will have longitudinal edges approximately 10 inches long and an upper edge approximately 5 inches long.

In the finished article, front panel 20 and liner panel 22 form a pocket by virtue of having their respective longitudinal and lower edges secured together. Back panel 36, in the finished article, extends between and is secured to the respective longitudinal edges of the pocket formed by front panel 20 and liner panel 22, as will be hereinafter clarified. Back panel 36 is preferably trapezoidal in outline, and has a top edge 38 which is slightly longer than its lower edge 40, with top edge 38 preferably being somewhat shorter than top edges 30, 31 of front and liner panels 20, 22. Longitudinal edges 42 and 44 of back panel 36 thus converge slightly toward each other from top edge 38 to lower edge 40. Back panel 36 is shorter in length than front panel 20 and liner panel 22 in the preferred embodiment, such that when top edge 38 of back panel 36 is aligned with the top edges 30, 31 of front and liner panels, 20 and 22, respectively, lower edge 40 of back panel 36 is in the vicinity of the topmost extent of intermediate end portions **28*c* and 29*c* and preferably at a point approximately one-half to one inch above the topmost extent of intermediate end portions 28*c* and 29*c* of front and liner panels 20 and 22**. For a medium sized gaiter, the back panel will have longitudinal edges approximately 11 inches long, an upper edge approximately 4½ inches long and a lower edge approximately 4 inches long.

Instep strap 43 has a rectangular outline and is made from elastic material. Opposing end edges 45 and 47 of instep strap 43 are slightly less wide than the length of opposing straight end portions **28*a*, 28*b* and 29*a*, 29*b*. In the finished articles, end edge 45 of instep strap 43 is secured between straight end portions 28*a* and 29*a* of front and liner panels 20 and 22, while end edge 47 is secured between straight end portions 28*b* and 29*b* of front and liner panels 20 and 22. Instep strap 43 is sufficiently long to permit the athlete's foot to be positioned between the strap 43** and the lower edge of the gaiter in the finished article. For a medium sized gaiter, the instep strap will be approximately 5½ inches by 1½ inches.

Back strap 48 and back strap cover 50 are also both rectangular in outline, with back strap cover 50 being slightly greater than twice as wide as back strap 48, both back strap 48 and back strap cover 50 being substantially identical in length to the length of lower edge 40 of back panel 36. Back strap 48 may vary in width, but will typically be about ½ inch. Back strap 48 is made from an elastic material while cover 50 is preferably made from the same material as is back panel 36, front panel 20 and liner panel 22.

The collar 52 is also rectangular in outline, and is preferably made from a stretchable nylon fabric similar to that of the front, liner and back panels. Collar 52 has a length sufficient to completely encircle the wearer's leg near his knee, and a width sufficient to help hold the gaiter in place in the vicinity of the wearer's knee. For a medium sized gaiter, the collar will be approximately 9 inches by 5 inches. Since the collar is preferably doubled over longitudinally before it is secured to the top edges of the front panel 20, liner panel 22 and back panel 36, the width of the collar in the finished article will thus be approximately one-half of its original width.

Figure 4A:
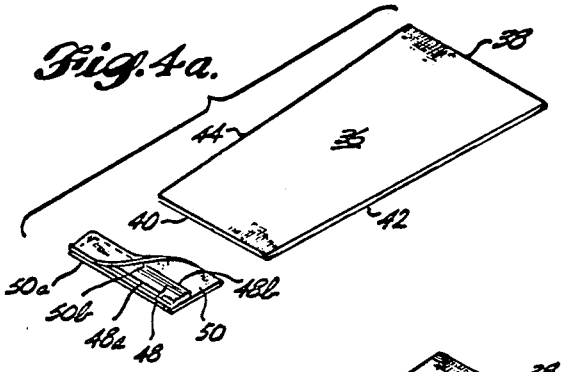
FIG. 4*a* is an isometric view of the first step in one method of securing an elastic back strap to the back panel, showing the convering of the elastic back strap by a back strap cover.
Figure 4B:
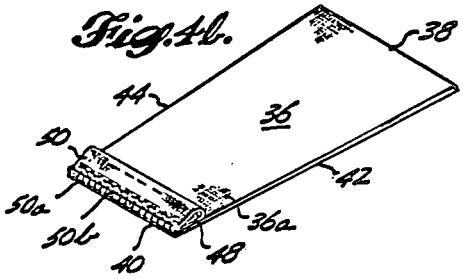
FIG. 4*b* is an isometric view showing the second step in the method of FIG. 4*a*, in which the combination of back strap and cover is secured along one edge to the lower edge of the back panel.

Referring now to FIGS. 4a–4d, a first method for securing back strap 48 to back panel 36 is shown. The first method includes the use of back strap cover 50. In the first step, shown in FIG. 4a, back strap 48 is positioned on and aligned lengthwise with back strap cover 50, with longitudinal edge 48a of back strap 48 being positioned parallel with, but slightly inward of, longitudinal edge 50a of cover 50. The surface of cover 50 desired to be exposed is facing downward, opposite from the surface on which back strap 48 is placed. Longitudinal edge 50b of cover 50 is then rotated about longitudinal edge 48b of back strap 48 until longitudinal edges 50a and 50b of cover 50 are aligned, terminating in a common plane, thereby enclosing back strap 48 along its length. The combination of cover 50 and back strap 48 is then positioned on the surface 36a of back panel 36 which is to be exposed as shown in FIG. 4b, such that longitudinal edges 50a and 50b of cover 50 terminate in a common plane with lower edge 40 of back panel 36, with the combination of back strap 48 and cover 50 extending inwardly of back panel 36 from its lower edge 40 thereof on surface 36a. In this position, lower edge 40 of back panel 36 and longitudinal edges 50a and 50b of cover 50 are secured together therealong. In the preferred embodiment a particular sewing stitch known in the art as serging is used for added strength, although other stitching may conveniently be used.

Figure 4C:
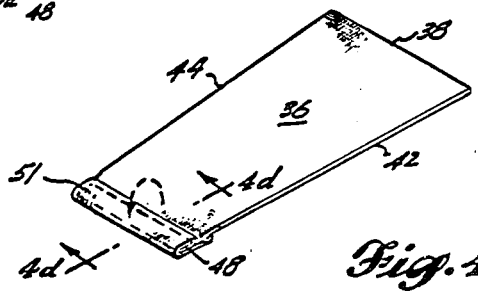
FIG. 4*c* is an isometric view showing the third step in the method of FIGS. 4*a* and 4*b*, in which the combination of the back strap and cover, now secured to the back panel, is rotated 180° about the one secured edge.
Figure 4D:
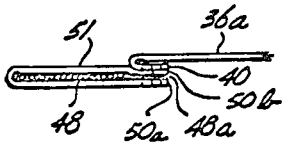
FIG. 4*d* is a cross-sectional view of the article of FIG. 4*c*, taken along lines 4*d*—4*d* in FIG. 4*c*.

Referring to FIGS. 4c and 4d, the combination of cover 50 and back strap 48, now serged to the back panel 36, is then rotated 180° about secured edges 48, 50a and 50b, such that portion 51 of cover 50 originally lying adjacent surface 36a of back panel 36 during the step of sewing shown in FIG. 4b is now effectively an extension of the length of back panel 36, and parallel therewith.

Referring now to FIGS. 5a and 5b, a second method of securing back strap 48 to back panel 36 is illustrated. This second method eliminates cover 50 although the back panel 36 of FIGS. 4a–4d is extended in length substantially corresponding to the width of cover 50. Referring to FIGS. 5a and 5b, a portion 54a of extended back panel 54 is first folded back upon extended back panel 54 about transverse line 56, until portion 54a lies adjacent the remainder of extended back panel 54. In this position, a portion 55 of lower surface 57 lying between lower edge 58 and edge line 56 of extended back panel 54 is now exposed. Back strap 48 is then positioned on portion 55 in such a fashion that longitudinal edge 48a of back strap 48 is positioned parallel with, and slightly inwardly of, extended back panel transverse line 56. The lower edge 58 of extended back panel 54 is then rotated about the other longitudinal edge 48b of back strap 48 until lower edge 58 terminates at the same plane with and comes into contact with, transverse line 56. In this position portion 54a encloses back strap 48 along its length. Lower edge 58 of extended back panel 54 is then secured to transverse line 56 by means of serging. The result provided by the method of FIGS. 5a and 5b is very similar to that of the method of FIGS. 4a–4d, except that, in FIGS. 5a and 5b, extended back panel 54 combines the back panel 36 and cover 50 of FIGS. 4a–4d.

FIG. 6 shows a variation of the method of FIGS. 4a–4c. Instead of using back straps and covers precut to the particular length required for use with a single back panel, a continuous strip 60 of back strap material and a continuous strip 61 of cover material is provided, with back panels 36 being successively positioned along and sewn to the combination of continuous strips 60 and 61. The combination of continuous strips 60 and 61 is then severed between adjacent back panels 36 after it has been secured to the back panels 36.

FIGS. 7a–7g illustrate the steps of the method of the present invention in securing together front panel 30, liner panel 22, instep strap 42 and back panel combination 62, which is defined as the end product of the methods illustrated in FIGS. 4a–4c, 5a–5b or 6. FIGS. 7h and 7i illustrate the step of positioning the protective pad 32 in the article produced by the method of FIGS. 7a–7g.

Referring to FIG. 7a, front panel 20 and liner panel 22 are initially positioned so as to be in vertical alignment with each other, while back panel combination 62 is positioned intermediate thereof and positioned such that its longitudinal edge 42 terminates in a common vertical plane with longitudinal edge 26 of front panel 20 and longitudinal edge 27 of liner panel 22. Back panel combination 62 is also positioned such that it terminates in the same vertical plane as upper edge 30 of front panel 20 and upper edge 31 of liner panel 22. In this initial relationship, with back panel combination 62 interposed between and contacting front panel 20 and liner panel 22, longitudinal edges 26, 27 and 42 of front panel 20, liner panel 22, and back panel combination 62, respectively, are secured together along a line 63, as shown in FIG. 7b. In the preferred embodiment, the securing is accomplished by sewing, preferably serging, for purposes of maximum strength.

Referring now to FIG. 7c, end edge 45 of instep strap 43 is initially positioned between and aligned with, straight end portion 28b of front panel 20, and straight end portion 29b of liner panel 22. Instep strap 43 is initially oriented such that it extends inward of front panel 20 and liner panel 22 from its position between straight end portions 28b and 29b. Referring now to FIG. 7d, the end portions 28b and 29b of front panel 20 and liner panel 22 and interposed end edge 45 of instep strap 43 are then secured together, preferably by a serge stitch, along line 65.

Instep strap 43 is then stretched in the direction of its length and positioned such that end edge 47 of instep strap 43 lies between and terminates in a common plane with straight end portion 28a of front panel 20, and straight end portion 29b of liner panel 22. In this relative position of front panel 20, liner panel 22 and instep strap 42, intermediate end portions 28c of front panel 20 and 29c of liner panel 22 will also be aligned with each other, and are then secured together, again preferably by a serge stitch, along line 67, as shown in FIG. 7d. Instep strap 43 is not secured to front panel 20 or liner panel 22 along line 67. Next, as shown in FIG. 7d, straight end portion 28a of front panel 20, straight end portion 29a of liner panel 22, and interposed end edge 47 of instep strap 42 are secured together along line 69, again by sewing, and preferably by serging. Instep strap 43 is at this point securely attached at its respective end edges 45, 47 to front panel 20 and liner panel 22, thereby defining a stirrup for the gaiter.

Referring now to FIG. 7e, back panel combination 62 is next stretched laterally such that its longitudinal edge 44 is aligned with longitudinal edges 24 of front panel 20 and 25 of liner panel 22. In this position, they are secured together along line 71, preferably by serging. At this point, the article of FIG. 7*e* is turned inside out by pulling the instep strap 43 back through the gaiter between the front panel 20 and the back panel combination 62, and out beyond the upper edges 30 and 31 of front and liner panels 20 and 22, thereby reversing the relative vertical positions of back panel combination 62, front panel 20 and liner panel 22. As shown in FIG. 7*g*, following the step of pulling the gaiter inside out, front panel 20 and liner panel 22 are now adjacent each other, and back panel combination 62 is positioned adjacent liner panel 22. In use, the wearer inserts his leg between liner panel 22 and back panel combination 62, with instep strap 43 being positioned around his foot.

FIGS. 7*h* and 7*i* illustrate the positioning of protective pad 32 into a gaiter pocket 73 which is defined by the lines of sewing 63, 65, 67, 69 and 71 (not shown in FIGS. 7*h* and 7*i*). The protective pad 32 is inserted into pocket 73 between front panel 20 and liner panel 22 until its own outline substantially mates with the outline of the pocket 73. FIG. 7*i* shows the protective pad 32 in place in pocket 73.

FIGS. 8*a* and 8*b* illustrate a first method for making the collar of the gaiter. Referring to FIG. 8*a*, collar 52 is first folded transversely such that lateral edges 64 and 66 thereof lie adjacent and terminate in a common vertical plane. In this position, lateral edges 64 and 66 of collar 52 are secured together, along line 75, preferably by serging. The collar 52 is next expanded outwardly to form a cylinder, with each longitudinal edge 68 and 70 of collar 52 thereby defining substantially a circle. Longitudinal edge 68 is then moved outwardly and downwardly until it lies adjacent to and terminates in a common plane with longitudinal edge 70. In this orientation, line 75 is hidden, as shown in FIG. 8*b*.

FIGS. 9*a* through 9*f* illustrate another method for making the collar. Referring to FIG. 9*a*, the lateral edges 64 and 66 of collar 52 are again initially positioned so that they lie adjacent one another and terminate in a common plane. However, instead of serging lateral edges 64, 66 at this point as was done in the method of FIGS. 8*a* and 8*b*, the transversely folded collar of FIG. 9*a* is folded again about a longitudinal midpoint, such that oppositely disposed end points 72 and 74 of the lateral edges 64, 66 of FIG. 9*a* lie adjacent one another. In this position, the now twice folded collar is serged adjacent the lateral edges 64, 66 along line 77. Longitudinal edge 68, which is the topmost longitudinal edge, and which has opposite ends secured together at end point 74, is then pulled up slightly as shown in FIG. 9*c*, and opened so that it defines a somewhat distorted ellipse. Referring to FIGS. 9*d* and 9*e*, longitudinal edge 68 is then folded over the remainder of the collar 52, until longitudinal edge 68 encircles longitudinal edge 70, and terminates in a common plane therewith, resulting in line 77 being rotated out of view. The end result of the steps of FIGS. 9*d* and 93 is the collar illustrated in FIG. 9*f*.

Figure 10:
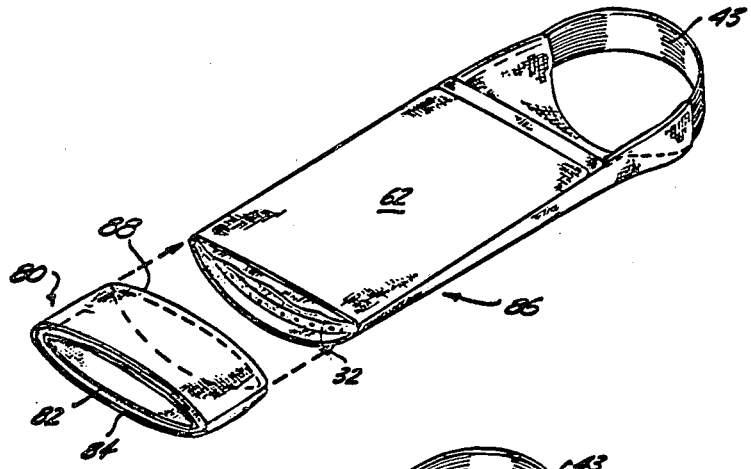
FIG. 10 is an isometric view of the step of the method of manufacturing a protective gaiter of attaching the collar to the remainder of the protective gaiter.
Figure 11:
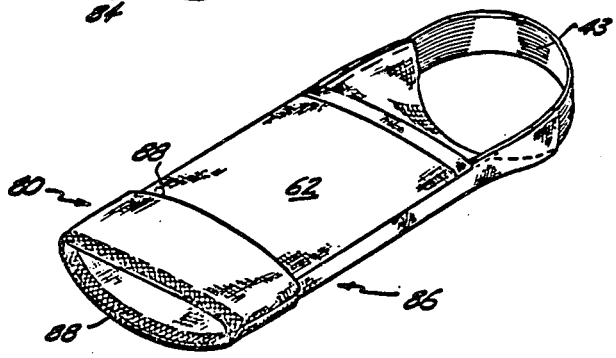
FIG. 11 is an isometric view showing the step of sewing the longitudinal edges of the collar to the upper edges of the front panel, back panel and liner panel.
Figure 12:
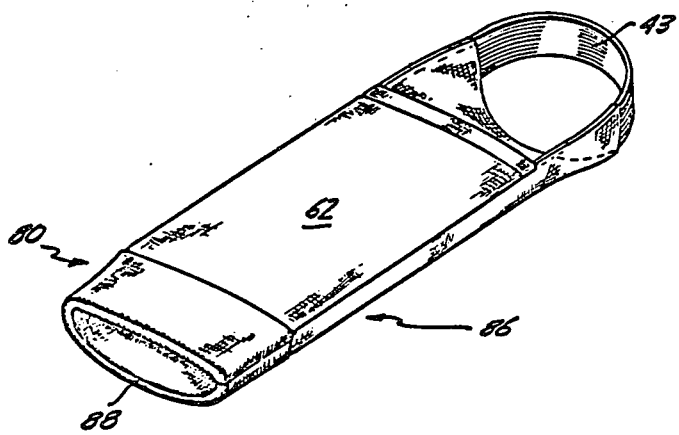
FIG. 12 is an isometric view showing the completed protective gaiter.

The folded collar, shown in FIGS. 8*b* and 9*f*, is now ready for attachment to the gaiter of FIG. 7*k* to complete the manufacture of the article. Referring to FIG. 10, the folded collar 80 is oriented so that it may be slipped over and around the body of the gaiter 86, beginning at the upper edges 30, 31 and 38, respectively, of front panel 20, liner panel 22 and back panel combination 62. Folded edge 88 of collar 80 is initially presented adjacent upper edges 30, 31 and 38 and it is then fitted over the gaiter 86 and then slid down a portion of the length of the gaiter 86 such that longitudinal edges 82 and 84 of collar 80 terminate in the same plane with upper edge 38 of back panel combination 62, upper edge 30 of front panel 20 and upper edge 31 of liner panel 22. In this position, longitudinal edges 82 and 84 of collar 80 are serged along line 81 to back panel combination 62 and the combined upper edges 30 and 31 of the front and liner panels, respectively, thereby defining an opening between back panel combination 62 and liner panel 22, as shown in FIG. 11. Lastly, folded edge 88 of folded collar 80 is rotated approximately 180° about line 81, thereby extending the length of the gaiter. In use, the collar helps to maintain the gaiter in place on a wearer's leg. FIG. 12 shows the completed protective gaiter.

Another embodiment of the invention is shown in FIGS. 13 and 14. This embodiment is particularly adapted for use on the forearm of a user, typically for contact sports such as football, but may also be conveniently used as a protective guard on the lower leg of the user as well, in a manner similar to that for the above-described embodiment.

The embodiment of FIGS. 13 and 14, shown generally at 201, is in many ways similar to the embodiment shown in FIGS. 1 through 12. It includes a gaiter-like body, referred to as a sleeve, which in turn comprises three sections: a front panel 203, a liner panel 205 which is identical in configuration to the front panel and a back panel 207. Front panel 203, liner panel 205 and back panel 207 have the same general configurations shown for those same elements in FIG. 3, with the exception that the front panel and the liner panel are squared off at their lower edges 203*a* and 205*a*, respectively, and the panels are each somewhat more tapered.

As with the embodiment of FIGS. 1–12, there is a pocket defined between the front panel 203 and the liner panel 205 into which is inserted a protective pad 209, which is constructed and configured similarly to the corresponding element shown in FIG. 3, again with the exception that its lower edge is squared off to conform to the outline of the pocket defined by the front and liner panels, and it is more tapered.

At one end 201*a* of the article 201 is a strap 211 which has the same configuration, and is similarly attached to the front, liner and back panels, as the back strap described with respect to the embodiment of FIGS. 1–12. At the other end 201*b* of the article is a collar 213, shown partially cutaway, which is configured virtually identical to the collar for the embodiment of FIGS. 1–12.

In the embodiment of FIGS. 13 and 14, which is particularly adapted to be used on a forearm (see FIG. 14), the characteristics of the materials used in the article, and the configuration of the various portions of the article become more critical than for the embodiment of FIGS. 1–12.

It is important that the article remain in place, even during violent movement of the user, including contact with another object, such as an opposing player. The material in the panels is sufficiently resilient to hold the article in place, without the use of straps, etc. Furthermore, the tapered configuration of the panels and protective pad assists significantly in achieving this desired result.

It is important that the material for the front, liner and back panels be made of a stretchable material which is sufficiently resilient, compared to the flexibility of the protective pad, that the pad is flexed to substantially conform to the circumferential outline of the arm or lower leg when the article is in place, without impairing the capability of the pad to absorb shocks.

Stretchable nylon has been found to be satisfactory. The finished article is thus so configured that it may be conveniently put on and removed, while it is maintained tightly in place when it is on the forearm.

Strap 211 also aids in maintaining the article in place on the user, because strap 211 is configured to result in a tight fit about the wrist or ankle of the user. Furthermore, strap 211, being made of a somewhat stiff, elastic material, aids in protecting the user's wrist from harm. Collar 213, being also made from an elastic material assists in maintaining the article in place, particularly assisting in preventing longitudinal movement of the article on the forearm.

Further assisting in maintaining the article in place is the type of stitching and the type of thread used. The various portions of the sleeve are sewn in a particular fashion, for example, serging, so that the stitching will not pull out when the sleeve is stretched as it is pulled onto and over the limb of the user. The thread, being itself stretchable to a degree, assists in permitting the sleeve to be stretched without the stitching being broken.

All of these qualities, namely the configuration of the front, liner and back panels and the protective pad, the resilience of the material used for the front, liner and back panels, the flexibility of the protective pad, the configuration, resilience, and protective quality of the strap, the configuration and resilience of the collar, and the stretch quality of the thread and stitching all combine to provide the necessary characteristics of the embodiment of FIGS. 13 and 14.

FIG. 14 shows the article in place on the forearm of a user. In practice, the user's arm is inserted between the back panel 207 and the liner panel, stretching the back panel and portions of the liner and front panels significantly from their rest state. This action causes protective pad 209 to flex to conform generally to the circumferential outline of the forearm, i.e., the pad will describe an arc in cross-section. The protective pad thus must have not only a substantial ability to absorb contact energy, but also enough flexibility to conform generally to the shape of the arm. When the article is in place, the protective pad extends around substantially one-half, or slightly more, of the forearm, giving the desired protection for the user.

The action of the material comprising the sleeve in attempting to return to its rest state clamps the user's arm between the back panel and the remainder of the article, thus preventing movement of the article even during violent action of the user. The various panels are all tapered to conform to the natural taper of the user's arm to assist in this clamping action. Strap 211 is positioned around a portion of the user's wrist, while collar 213 is positioned around the upper part of the forearm, both further assisting in the clamping action.

The article may be conveniently put on and off any number of times, thus eliminating the cumbersome straps or other binding means of the prior art, without in any way harming its clamping qualities which maintain it securely in place on the user's arm.

The process for manufacturing the article of FIGS. 13 and 14 is substantially identical to that shown and described above for the embodiment of FIGS. 1–12, taking into consideration the fact that the front panel, liner panel and protective pad are of somewhat different configuration, particularly their taper, and further, that there is no instep strap. Otherwise, however, the assembly steps described above can be easily adapted to the embodiment of FIGS. 13 and 14.

Figure 15:
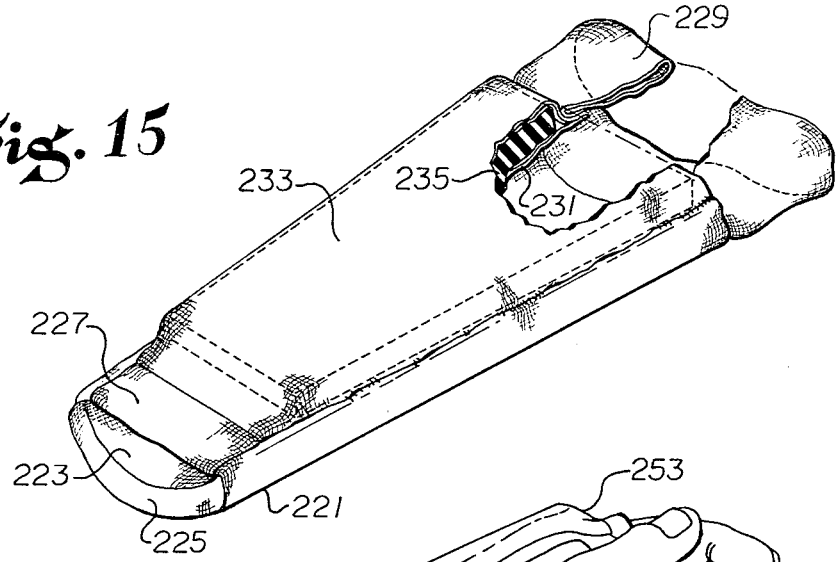
FIG. 15 is an isometric view of a first variation of the arm guard of FIG. 13, in which an additional pad is provided to give protection around the entire arm.

FIG. 15 shows a first variation of the embodiment of FIG. 13. The variation of FIG. 15 includes a front panel 221, and a liner panel 223 identical in configuration to front panel 223 which are secured together to form a first pocket into which a first protective pad 225 is inserted. Front panel 221, liner panel 223 and first protective pad 225 are identical in configuration and size to corresponding elements in the embodiment shown in FIG. 13. In addition, a strap 227 and a collar 229 are attached to opposite longitudinal ends of the article of FIG. 15, for the purpose of securely holding the article in place on the user's forearm. These elements likewise are similar in size and configuration to corresponding elements in the embodiment of FIG. 13.

Two back panels 231 and 233, of substantially identical size and configuration, are provided to form the back of the arm guard. The back of the arm guard, when the article is properly positioned on the user, covers the inside portion of the forearm of the user. First back panel 231 is similar in size and configuration to the corresponding back panel in FIG. 13, and in combination with second back panel 233, which is secured to the first back panel along the respective edges thereof, forms a second pocket into which a second protective pad 235 is inserted.

The second pocket and the second protective pad 235 extend substantially the length of the article, and when the article is in place, covers the inside portion of the user's forearm. Second protective pad 235 may be thinner than the first protective pad. For instance, second protective pad 235 may be on the order of $\frac{3}{8}''$ thick, while first protective pad 225 may be $\frac{1}{2}''$ thick. Such an article will fit tightly and securely on the forearm of a user with minimal discomfort or interference with the user's actions.

In certain circumstances, it may be desirable to have a non-skid surface on the exposed second back panel 233. Hence, a special non-skid material may be used for the second back panel 233, or a section of such material may be attached to second back panel 233 by an adhesive or similar means. This will assist a ball carrier in the game of football, for instance, in maintaining control of the ball, particularly when the ball is slippery due to rain or mud.

Figure 16:
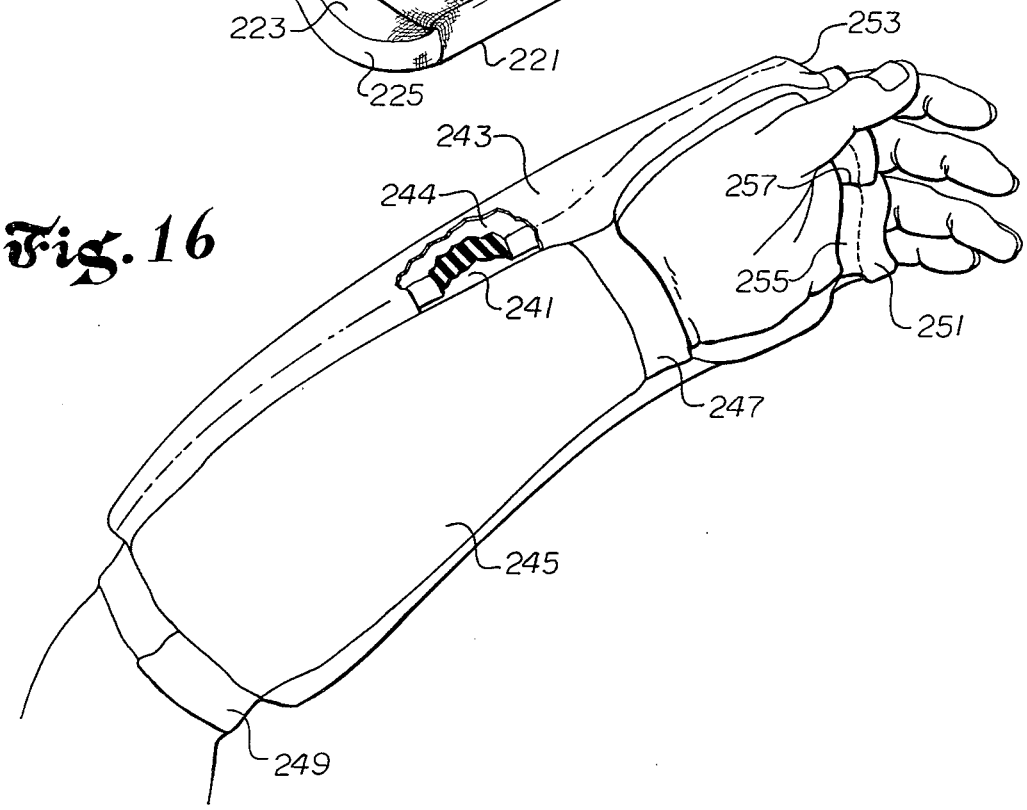
FIG. 16 is an isometric view of a second variation of the arm guard of FIG. 13, shown on a user's arm, in which the sleeve pocket and the protective insert extend beyond the user's wrist to the vicinity of the first knuckles of the user's hand.

FIG. 16 shows a second variation of the article of FIG. 13. The article of FIG. 16 is substantially identical to the article of FIG. 13, except that the pocket formed by the front and liner panels, as well as the protective pad therein, extends beyond the ordinary termination point of the article, i.e. at the wrist strap, to approximately the first knuckle of the user, or slightly beyond, when the article is in place of the user's forearm.

Referring now in detail to FIG. 16, the article includes a front panel 241, a liner panel 243, and a back panel 245. Front panel 241 and liner panel 243 form a pocket into which is inserted a protective pad 244. An elastic wrist strap 247 and a collar 249 are secured at opposite ends of the article, in similar fashion to that shown and described for the article of FIG. 13.

Front panel 241 and liner panel 243, however, instead of terminating in the vicinity of wrist strap 249, extend forwardly of strap 249 for a distance of approximately 2 to 3 inches. They are still secured together along their mating edges over that additional distance and thereby form an extended pocket. Into this pocket is inserted the protective pad 244, which has the same configuration as the pocket, so that when the article is correctly positioned on the user's forearm, the pocket and the protective pad extend over, and substantially cover, the back of the user's hand, terminating in the vicinity of the first knuckles of the user's hand, or beyond the first knuckle a small distance, i.e. approximately 1 inch.

Figure 17:
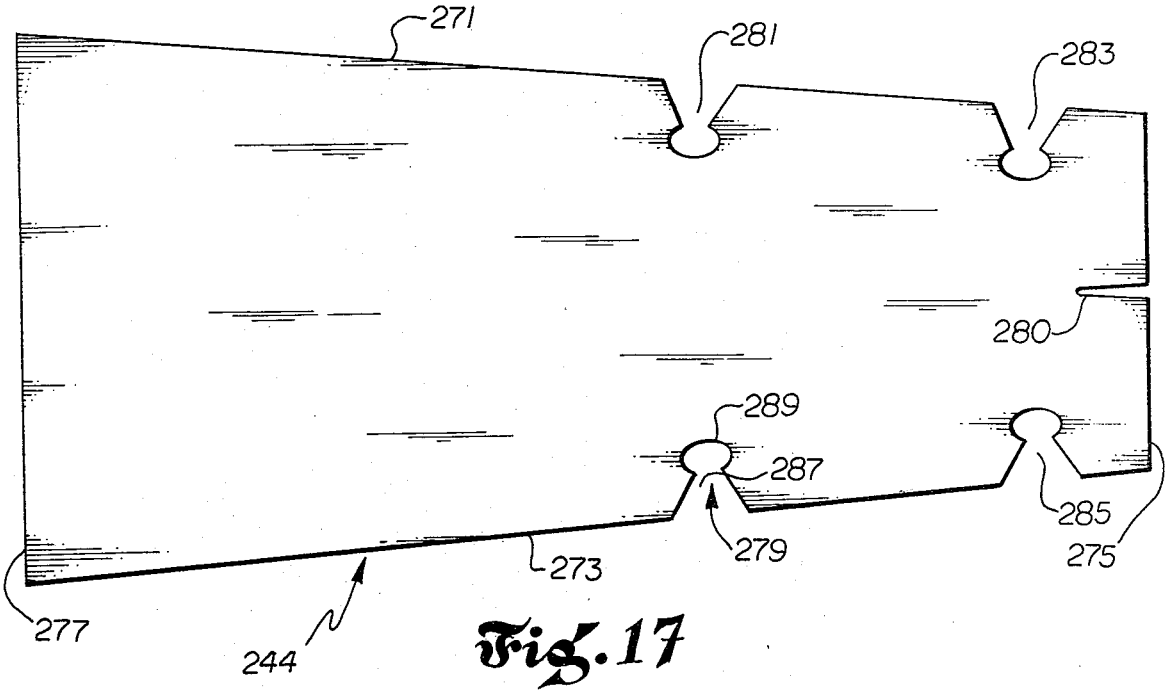
FIG. 17 is a plan view of the protective insert for the embodiment of FIG. 16.

FIG. 17 shows the protective pad 244 which is used with the second variation of FIG. 16. When the article is in place, the protective pad 244 extends from the upper forearm of the user, extends over the wrist and the back of the user's hand, terminating at a point which is approximately one inch beyond the first knuckle of the user's hand, thus providing substantial protection to the user's arm and hand.

As is shown in FIG. 17, the protective pad 244 is tapered, to conform to the general taper of the arm so as to result in a tight fit over the forearm and hand of the user. As in the other embodiments, protective pad 244 is a closed-cell, foam-like material, such as poly-vinyl chloride. In one size of the embodiment shown, protective pad 244 is approximately 11½ inches long from end to end, with the two longitudinal edges 271 and 273 being approximately 11⅝ths inches long and end edges 275 and 277, respectively, being approximately 3⅝ths inches and 5⅝ths inches long. Pads for other size arm guards will, of course, have other dimensions, although the relationship of the various dimensions should remain approximately the same from size to size.

A significant feature of the protective pad 244 of FIG. 17 is the keyhole shaped slots 279, 281, 283 and 285 which are positioned in pairs and extend into the body of the pad from the longitudinal edges 271 and 273. The first pair of keyhole slots 279 and 281 extend from the opposite longitudinal edges at approximately 4⅝ths inches from end edge 275, and are located approximately in the vicinity of the line of the wrist joint, when the article is in place. The second pair of keyhole slots 283 and 285 extend from the opposite longitudinal edges at approximately 1⅛th inches from end edge 275 and are located approximately in the vicinity of the first knuckle when the article is in place. A narrow longitudinal slot 280, exxtending inwardly of the article from end edge 275, approximately ⅝th inch, also aids in the movement of the pad.

Each keyhole slot has approximately the same configuration, with a first portion 287 in the form of a truncated triangle, wider at its base, and a second portion 289 in the form of an oval. The first portion communicates with the second portion, so that the slot extends from the longitudinal edge into the second portions.

The keyhole slots 279, 281, 283 and 285 are significant operationally, as they permit the user to bend his wrist and to clinch his fist without the protective pad bunching at the joints, or anywhere else along its length. Hence, the tapered sleeve and protective pad, with the protective pad having keyhole-shaped slots at the wrist and first knuckle, results in an arm guard which provides padded protection for the user over forearm, and the hand, without hindering the user's freedom of movement.

In order to help maintain the article of FIG. 16 in place, a circular retaining cuff 251, approximately one inch wide and eight inches in circumference, is secured to the free end 253 of the extended pocket. A portion of the cuff may be an elastic strip 255, which is secured between the opposing edges of the pocket. In a variation, just the elastic strip may be provided. The cuff 251 is secured along one edge thereof over approximately one-half its circumference to the free edge 253 of the extended pocket, thereby forming an opening between the pocket/pad and cuff 251, through which the user's hand may be inserted.

A portion of cuff 251 will thus lie across the palm of the user along approximately the first knuckle line, thus leaving the thumb free, as shown in FIG. 16. Cuff 251 is stitched or tacked together, or tacked to the extended pocket at the midpoint of the cuff along line 257, so as to form two small openings between cuff 251 and the extended pocket/pad, instead of one large one. Two fingers may be inserted through each opening, so that the line of stitching is located between the middle and ring fingers of the user's hand. The line of stitching helps to maintain the extended pocket/pad in place on the back of the user's hand and prevents the article from riding up the user's arm.

The article of FIG. 16 is especially useful for those athletes, such as football linemen, who need additional protection for their hands and knuckles. The article provides this additional protection without in any way interfering with the user's capability to use his hands in the game.

It should be understood that other modificatiions and changes can be made to the arm guard shown and described herein without departing from the spirit of the invention, which is defined by the claims which follow.

What is claimed is:

1. An arm guard, comprising:

a generally cylindrical sleeve-like element which is tapered from one end to the other and otherwise configured to substantially conform to the shape of a human forearm, wherein said sleeve has first and second closed pockets defined therein which extend substantially from said one end thereof to said other end, each pocket extending around approximately one-half of the circumference of said sleeve-like element; and first and second protective pads enclosed in said first and second pockets, wherein said protective pads are tapered from one end thereof to the other end and extend substantially the length of said sleeve-like element, each protective pad extending around approximately one-half of the circumference of the user's forearm, and wherein said protective pads are sufficiently flexible that they conform substantially to the circumferential outline of the user's forearm, and wherein said sleeve-like element, when stretched to fit over the user's forearm, is sufficiently elastic that said sleeve-like element and said protective pad are held in place on the user's arm even during violent movement thereof, including contact with another object.

2. An arm guard, comprising:

a generally cylindrical sleeve-like element which is tapered from one end to the other end and otherwise configured to substantially conform to the shape of a human forearm, including a portion which extends over the back of a human hand to a point beyond the first knuckle of the user's hand, wherein said sleeve-like element has a closed pocket defined therein which extends substantially from said one end thereof to the termination point of the article, said closed pocket extending around approximately one-half of the circumference of the article over the length of the user's forearm, and over the area of the back of the hand and the first knuckle of the user's hand;

a protective pad enclosed in said pocket, wherein said protective pad is tapered from one end thereof to the other end and extends substantially the length of the sleeve-like element, and around substantially one-half of the circumference of the user's forearm and over the back of the user's hand to a point beyond the first knuckle thereof, and wherein said protective pad is sufficiently flexible that it conforms substantially to the circumferential outline of the user's forearm and the back of the user's hand, and wherein said sleeve-like element, when stretched to fit over the user's forearm, is sufficiently elastic that said sleeve-like element and said protective pad are held in place on the user's arm even during violent movement thereof, including contact with another object; and a collar-like element secured to said sleeve-like element at the termination point thereof, said collar-like element having two openings defined therein to receive therethrough the user's fingers, so as to prevent the article from moving back along the user's arm or away from the back of the user's hand.

3. An arm guard, comprising:

a generally cylindrical sleeve-like element which is tapered from one end to the other and otherwise configured to substantially conform to the shape of a human forearm, including a portion which extends over the back of the user's hand to a termination point beyond the first knuckle thereof, wherein said sleeve-like element has a closed pocket defined therein which extends substantially from said one end thereof to the termination point of the article, said closed pocket extending around approximately one-half of the circumference of the article over the length of the user's forearm, and over the area of the back of the user's hand and the first knuckle of the user's hand; and a protective pad enclosed in said pocket, wherein said protective pad is tapered from one end thereof to the other and extends substantially the length of said sleeve-like element, and around substantially one-half of the circumference of the user's forearm and over the back of the user's hand to a point beyond the first knuckle thereof, said protective pad including two pairs of keyhole-shaped openings which extend inward from the longitudinal edges of said pad, the first pair of openings being located at approximately the wrist area of the user, the second pair of openings being located at approximately the first knuckle area of the user, and wherein said protective pad is sufficiently flexible that it conforms substantially to the circumferential outline of the user's forearm and the back of the user's hand, and wherein said sleeve-like element, when stretched to fit over the user's forearm, is sufficiently elastic that said sleeve-like element and said protective pad are held in place on the user's arm even during violent movement thereof, including contact with another object.

4. The article of claims 1, 2 or 3 including the band of elastic material which is stiffer elastically then the material comprising said sleeve-like element, wherein said band is secured to the sleeve-like element at a point which is in the vicinity of the user's wrist when the article is in place, wherein the inner circumference of the article at said point is sufficiently less than the circumference of the user's wrist so that said band grips the user's wrist when in place, thereby assisting in preventing movement of said article along the user's forearm.

5. An article of claims 1, 2 or 3 wherein said sleeve-like element includes an elastic collar-like element which is attached to the sleeve-like element at the upper end thereof, wherein said elastic collar-like element is a cylindrical section of stretchable material which encircles the user's upper forearm and wherein the inner circumference of the collar-like element is sufficiently less than the user's upper forearm that said collar-like element aids in maintaining the article in place.

* * * * *